United States Patent [19]

Clifton

[11] Patent Number: 4,641,836

[45] Date of Patent: Feb. 10, 1987

[54] WEIGHT LIFTING APPARATUS FOR EXERCISING THE TRICEPS

[76] Inventor: Orville J. Clifton, Box 463, Inola, Okla. 74036

[21] Appl. No.: 749,650

[22] Filed: Jun. 28, 1985

[51] Int. Cl.[4] ..... A63B 11/00

[52] U.S. Cl. ..... 272/122; 272/123; 272/117

[58] Field of Search ..... 272/116, 117, 118, 122, 272/123, 124, 128, 93

[56] References Cited

U.S. PATENT DOCUMENTS

| | | | |
|---|---|---|---|
| 1,658,108 | 2/1928 | Vaughn | 272/122 |
| 3,679,204 | 7/1972 | Busby | 272/81 |
| 3,690,655 | 9/1972 | Chapman | 272/81 |
| 3,904,198 | 9/1975 | Jones | 272/81 |
| 4,043,553 | 8/1977 | Suarez | 272/128 |
| 4,226,414 | 10/1980 | Coffaro et al. | 272/117 |
| 4,252,316 | 2/1981 | Price | 272/123 |
| 4,274,628 | 6/1981 | Hoagland | 272/123 |
| 4,290,597 | 9/1981 | Schleffkndorf | 272/117 |
| 4,316,609 | 2/1982 | Silberman | 272/118 |
| 4,317,566 | 3/1982 | Uyeda et al. | 272/118 |
| 4,339,125 | 7/1982 | Uyeda et al. | 272/118 |
| 4,360,198 | 11/1982 | Waulters | 272/117 |
| 4,438,920 | 3/1984 | Veillette | 272/67 |
| 4,489,935 | 12/1984 | Lusk | 272/117 |
| 4,537,394 | 8/1985 | Golinsky, Jr. | 272/117 |

*Primary Examiner*—Richard J. Apley
*Assistant Examiner*—John L. Walsh
*Attorney, Agent, or Firm*—Head, Johnson & Stevenson

[57] ABSTRACT

A free weight, tricep exercise apparatus comprising a cross bar handle attached perpendicularly to one end of an arched support member and a post for holding weight lifting plates attached at the other end of the arched support member. The apparatus is used in a manner analogous to the dumbbell tricep curl exercise except the weights are positioned much lower allowing for greater stability and safer operation. Also, the device affords the user the opportunity to rest the weight of the user's back and legs be merely bending forward.

6 Claims, 6 Drawing Figures

WEIGHT LIFTING APPARATUS FOR EXERCISING THE TRICEPS

BACKGROUND OF THE INVENTION

1. Field of the Invention

This invention relates to a free weight, tricep exercise apparatus. More specifically, the invention relates to a curling bar comprising a handle and arched member that extends down the user's back and holds free weights at a relatively low center of gravity during the conventional tricep curl exercise.

2. Description of the Prior Art

It is generally known that exercising of the triceps (Triceps Brachii Longus) is a significant and important aspect of developing strength in the arm. As such, various types of weight lifting apparatus have been developed specifically to exercise this muscle group. However, when employing free weights, the triceps are usually exercised by elevating a dumbbell or bar bell directly overhead and then curling the weight back behind the head while maintaining the elbow as high as practical. The motion is then repeated by lifting the weight back overhead. Although very effective in exercising the triceps, the tricep curl is relatively dangerous, particularly when using heavy weights in that each repetition involves the weights passing directly overhead of the user while standing or seated in a relatively awkward position and motion.

SUMMARY OF THE INVENTION

In view of the problems associated with prior art, free weight, weight lifting apparatus when employed in the conventional tricep curl exercise, I have discovered an improved free weight, tricep exercise apparatus comprising:

(a) a handle means adapted during use of the tricep exercise apparatus, to be manually held overhead and behind the user's back while the user performs a tricep curl movement;

(b) a rigid, arched support means operatively attached at one end to the handle means and adapted, during use of the tricep exercise apparatus, to extend generally downward behind the user's back; and (c) a post means operatively attached near the other end of the rigid, arched support means and adapted, during use of the tricep exercise apparatus, to extend upwardly and outwardly from the back of the user such as to receive and retain weights.

It is an object of the present invention to provide a tricep curling apparatus that employs conventional weight lifting plates without elevating the weights directly overhead during the curling exercise. It is another object of the present invention to provide such an apparatus that will allow the user to terminate the exercise routing by merely leaning forward, thus resting the weights on the back and legs rather than the arms. Fulfillment of these objects and the presence and fulfillment of additional objects will be apparent upon complete reading of the specification and claims in light of the attached drawings.

DESCRIPTION OF THE PREFERRED EMBODIMENTS

Figure 1:
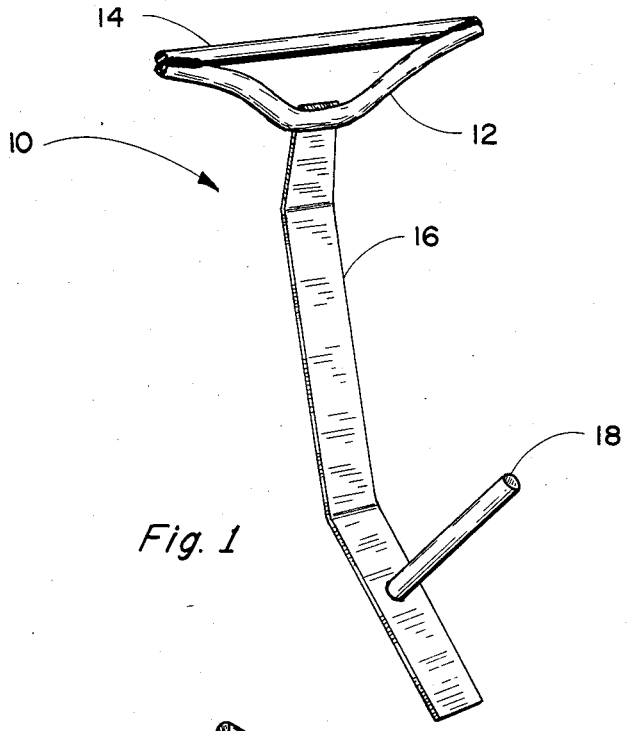
FIG. 1 is a perspective view of the weight lifting apparatus according to the present invention.
Figure 2:
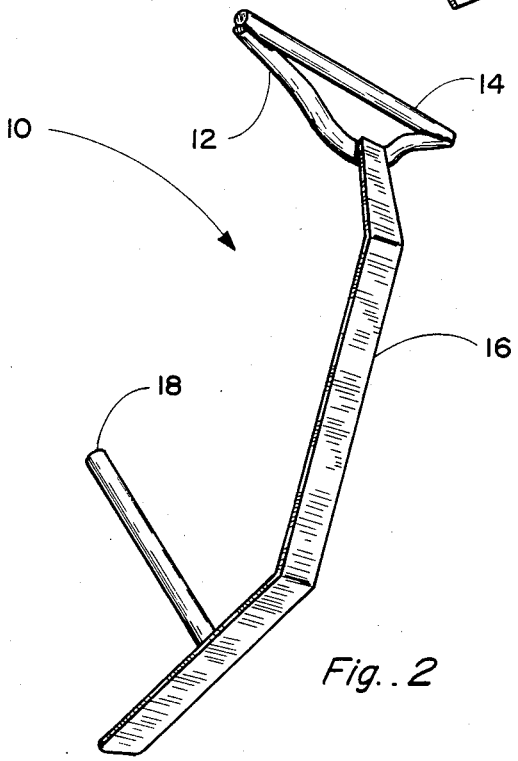
FIG. 2 is a perspective view of the weight lifting apparatus of FIG. 1 as seen from the backside.

The weight lifting, tricep exercising apparatus according to the present invention, how it operates and how it is used and how it differs from previously known devices as well as the advantages and benefits over previously known devices can perhaps be best explained and understood by reference to the drawings. FIGS. 1 and 2 illustrate one preferred embodiment of the weight lifting apparatus generally designated by the number 10.

This particular embodiment involves a bicycle handlebar-like system 12 with cross member 14 for manual gripping. The lower portion of the handlebar-like system is attached to a generally flat steel member 16 that extends, during use, downward from the handle system 12. As illustrated, the flat steel member 16 has, in this embodiment, two distinct bends creating a generally arched side profile during use, as will be explained later. Near the lower end of the flat member 16 is a post 18 perpendicularly attached to the flat member 16 generally midway in the lower segment of the arch, thus extending at an upward slope when in use. This post is sized such as to accept one or more conventional so-called free standing weights; i.e., the weight lifting plates or discs as generally known in the art.

Figure 3:
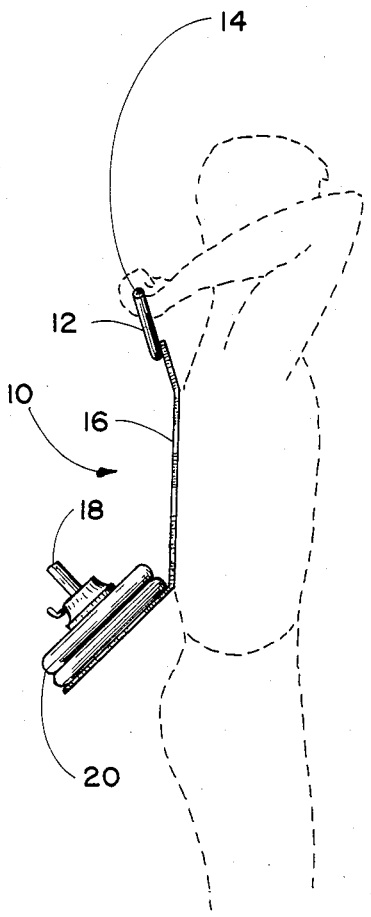
FIGS. 3 and 4 are side views of the weight lifting apparatus of FIG. 1 with weights illustrating its use during the tricep curl exercise.

As illustrated in FIG. 3, the weight lifting apparatus 10 is employed during exercise by gripping underneath the ends of the cross member 14 when using two hands (in the middle when using one hand, not shown) of the handle bar system 12 behind the back and over the shoulders of the user in a manner reminiscent of the conventional tricep curl exercise performed when using a dumbbell. However, the present device affords the opportunity to grip the apparatus with either hand or both, making the device more versatile as a tricep exercising piece of equipment. Also as illustrated in FIG. 3, the generally arched shape of the flat member 16 caused by the pair of bends allows the user's hands to extend behind and be displaced away from the shoulder blades while the weights 20 mounted to the post 18 are also displaced away from the lower back of the user. In this manner, the center of gravity of the overall apparatus, during use, will be displaced away from the lower back and preferably slightly beyond the grip of the user. This in turn creates a torque or force towards the user's back, thus causing the apparatus, as a whole, to tend to reside in contact or near contact with the user's body (i.e., the flat member 16 rubs the user's back). This creates stability and a high degree of awareness by the user as to the location of the device, even though it is behind the user.

Figure 4:
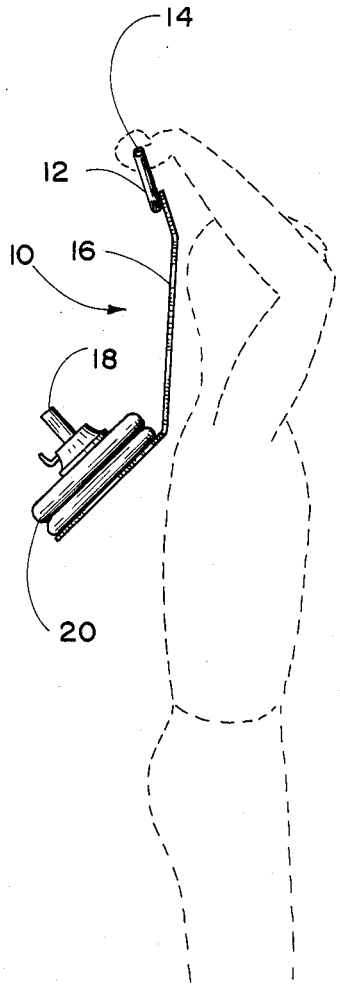

The weight lifting device is used by raising the hands and forearm while keeping the elbow and tricep as high as possible as illustrated in FIG. 4. In principle and as previously stated, the motion is to be repeated in a manner analogous to the conventional dumbbell tricep curl. However, the fact that the weights are slung well below the hand grip (i.e., the center of gravity of the apparatus is low relative to the conventional dumbbell tricep curl exercise) means that the risk associated with a falling weight or emergency release is minimized.

Figure 5:
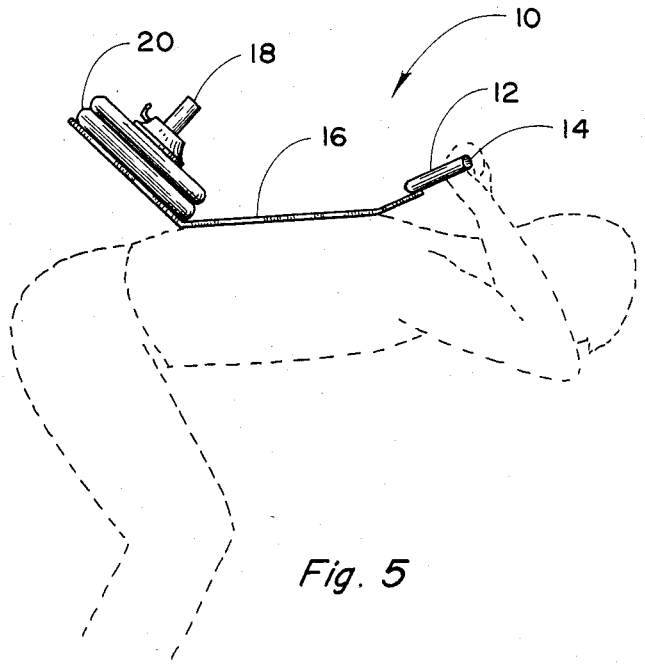
FIG. 5 is a side view of a method of terminating the tricep curl exercise by leaning forward resting the weights on the back and legs.

Also as illustrated in FIG. 5, the weight lifting apparatus according to the present invention incorporates an additional safeguard in the form of making available to the user an additional emergency movement. Because of the relatively low center of gravity of the weights and the tendency of the device to remain in relatively close contact with the user's back, the device can be lowered safely by having the user bend forward slightly or even kneel with the device, if necessary. Thus, if the user finds that too great a weight has been placed on the post, the exercise routine can be quickly and safely terminated by leaning forward. This shifts the weight onto the leg muscles which can then be used to stop the exercise and lower the weight to the floor. Thus, the present invention tends to be safer and yet afford the user greater confidence in employing heavier weights during exercising the tricep.

In order to use the exercise apparatus as illustrated in FIGS. 3 and 4, the desired weight must first be placed on the post and preferably locked in place by use of a bar lock or the like. The device is then raised or maneuvered into proper position for the workout or exercise routine. The starting maneuver and overall workout procedure for both the single arm workout and double arm workout are summarized in the following stepwise description of one overall preferred method of exercising as follows:

Steps for Using Tricep Bar for Single Arm Workout

1. Place feet shoulder-width apart and keep pelvis area tucked in.
2. Hold tricep bar vertically in front of you with the weight peg facing your body.
3. Place hands on the double (bottom handle), index fingers as close to the body as possible, and thumbs on the body*.
4. Lift bar.
5. Slowly swing tricep bar over right shoulder if right handed, left shoulder if left handed (so bar is behind user).
6. Once settled into position, change either hand from double (bottom) handle to center of single (top) handle. Grip the single (top) handle with fingers and place thumb along the bar. Release other hand from double (bottom) handle.
7. Keep elbow of the arm user is working out as close as possible to head.
8. Lift tricep bar until elbow is locked out (straight).
9. Slowly lower tricep bar.
10. Repeat until finished with repetitions.
11. When finished with repetitions, place both hands on the double (bottom) handle, index fingers as close to body as possible, and thumbs on body*.
12. Extend arms until elbows are straight.
13. If right handed, swing left arm over head, allowing tricep bar to come over right shoulder. If left handed, swing right arm over head, allowing tricep bar to come over left shoulder.
14. Place tricep bar firmly on the floor in front of user (weight peg facing body).

*If this position is uncomfortble, try wider grip on the double (bottom) bar until flexibility increases.

Steps for Using Tricep Bar for Double Arm Workout

1. Place feet shoulder-width apart and keep pelvis area tucked in.
2. Hold tricep bar vertically in front with the weight peg facing body.
3. Place hands on the double (bottom) handle, index fingers as close to body as possible, and thumbs on the body*.
4. Lift bar.
5. Slowly swing tricep bar over right shoulder if right handed, left shoulder if left handed (so bar is behind user).
6. Keep elbows as close as possible to head.
7. Lift tricep bar until elbows are locked out (straight).
8. Slowly lower tricep bar.
9. Repeat until finished with repetitions—extend arms until elbows are straight.
10. If right handed, swing left arm over head, allowing tricep bar to come over right shoulder. If left handed, swing right arm over head, allowing tricep bar to come over left shoulder.
11. Place tricep bar firmly on floor in front of user (weight peg facing user).

*If this position is uncomfortable, try wider grip on double (bottom) bar until flexibility increases.

Figure 6:
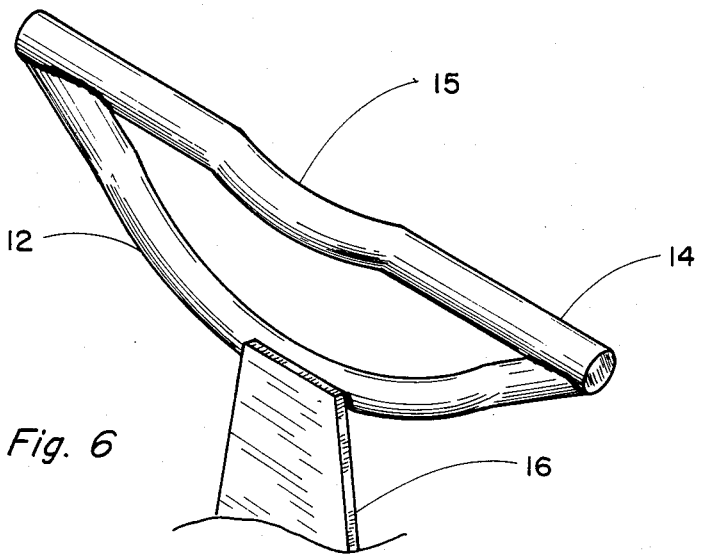
FIG. 6 is a perspective view of an alternate embodiment of the handle of a weight lifting apparatus according to the present invention.

It should be appreciated that other specific configurations, geometries, relative degrees of arch or bend, lengths, widths, size and shapes of hand grips and the like can be readily incorporated into the apparatus according to the present invention. As such, such changes are felt to be equivalent for purposes of this invention. Thus, for example, the flat member can in fact be generally any cross-sectional dimension adapted to and capable of making only slight contact with the human back during exercising including by way of example, but not limited thereto, tubular pipe, solid pipe, cast steel, machine steel or the like. Similarly, the generally arched configuration can be achieved by any method or shape that displaces the hand grip beyond the shoulder blades and conveniently and safely supports the weights behind the back. It should also be specifically appreciated that other various shapes, types and configurations of hand grips can be substituted for the handle bar with cross member illustrated in FIGS. 1 and 2. Thus, for example, but not limited thereto, FIG. 6 illustrates another handle 12 wherein the cross member 14 contains a centrally positioned small arched segment 15 that assists the user to hold the device when exercising only one arm or tricep. Various other types of handles and grips as generally known in the weight lifting art are compatible with the present invention, particularly when wrist action is desired and as such, are also felt to be equivalent for purposes of this invention.

The actual construction of the weight lifting apparatus according to the present invention can be out of any material generally employed in the weight lifting art. Preferably, the device is made from solid steel wherein the elements are welded to each other.

The advantages and benefits of using the apparatus according to the present invention are considered numerous and significant. Because the device employs free weights, it represents a relatively inexpensive piece of equipment in contrast to the contemporary alternatives of cabled or lever arm machines. Compared to the alternative free weight dumbbell or French curl bar, the apparatus of the present invention is relatively safe and allows for use of greater weight at minimum risk associated with an emergency or equipment failure. For example, the dumbbell or the like during the curling process hits the back of the user and potentially could hit the user's head since all the weight is elevated over the head during the exercise. Also, the failure of a lock on a dumbbell will result in the weights falling. In contrast, the apparatus of the present invention does not significantly hit or significantly rub on the user's back and the weights are never directly overhead. Also, the failure of a locking mechanism will not necessarily result in the weights falling. And as previously indicated, the apparatus according to the present invention gives the user a sense of control and a feeling of security with or without excessive weights. If the user becomes tired or gets a cramp during exercising, the present invention affords the user the opportunity to rest the bar against the back or bend over, taking the weight off the arms, thus representing a relatively versatile, inexpensive yet safe method of exercising the triceps.

Having thus described the invention with a certain degree of particularity, it is manifest that many changes may be made in the details of construction and the arrangement of components without departing from the spirit and scope of this disclosure. Therefore, it is to be understood that the invention is not limited to the embodiment set forth herein for the purposes of exemplification, but is to be limited only by the scope of the attached claims, including a full range of equivalents to which each element thereof is entitled.

I claim:

1. A free weight, tricep exercise apparatus comprising:

(a) a handle means adapted, during use of said tricep exercise apparatus, to be manually held overhead and behind the user's back while the user performs a tricep curl movement;

(b) a rigid, arched support means operatively attached at one end to said handle means and adapted, during use of said tricep exercise apparatus, to extend generally downward behind the user's back; and (c) a post means operatively attached near the other end of said rigid, arched support means, essentially perpendicular to said rigid, arched support means and directed substantially towards the center of the radius of curvature of said rigid, arched support means, said post means including a free end for receiving and retaining weights and an attached end being spaced from the other end of said rigid, arched support means so as to allow a weight to rest adjacent said rigid, arched support means.

2. A free weight, tricep exercise apparatus of claim 1 wherein said handle means is a shallow V-shaped handle with a cross member wherein the apex of the V is attached to the rigid, arched support means.

3. A free weight, tricep exercise apparatus of claim 2 wherein the center of said cross member of said shallow, V-shaped handle is an arched segment.

4. An exercise apparatus comprising:

(a) a handle;

(b) an arched member one end of which is attached to said handle; and (c) a post member attached near the other end of said arched member, essentially perpendicular to said arched member and directed substantially towards the center of the radius of curvature of said arched member, said post member including a free end for receiving and retaining weights and an attached end being spaced from the other end of said arched member so as to allow a weight to rest adjacent said arched member.

5. An exercise apparatus of claim 4 wherein said handle is a shallow, V-shaped handle with a cross member and wherein the apex of the V is attached to the arched member.

6. An exercise apparatus of claim 5 wherein the center of said cross member of said shallow, V-shaped handle is an arched segment.

* * * * *